US005653130A

United States Patent [19]

Dokoupilova et al.

[11] Patent Number: 5,653,130

[45] Date of Patent: Aug. 5, 1997

[54] PROCESS AND DEVICE FOR APPLYING LIQUIDS TO THE SURFACE OF LEATHER OR SIMILAR FLAT MATERIALS

[76] Inventors: Magda Dokoupilova; Jiri Dokoupil, both of Krusmannstrasse 17, D-65549 Limburg, Germany

[21] Appl. No.: 367,309

[22] PCT Filed: May 7, 1994

[86] PCT No.: PCT/DE94/00534

§ 371 Date: Jan. 13, 1995

§ 102(e) Date: Jan. 13, 1995

[87] PCT Pub. No.: WO94/26936

PCT Pub. Date: Nov. 24, 1994

[30] Foreign Application Priority Data

May 13, 1993 [DE] Germany ..... 43 16 008.5

[51] Int. Cl.[6] ..... C14C 1/00

[52] U.S. Cl. ..... 69/32; 69/21; 68/202; 68/204

[58] Field of Search ..... 69/29, 30, 31, 69/32, 21; 68/200, 202, 204, 205 R; 8/150.5

[56] References Cited

U.S. PATENT DOCUMENTS

| | | | |
|---|---|---|---|
| 2,868,614 | 1/1959 | Ushakoff | 68/204 |
| 3,574,278 | 4/1971 | Paterson | 68/204 |
| 4,050,269 | 9/1977 | Mayer | 68/204 |
| 4,442,560 | 4/1984 | van Wersch et al. | 68/204 |
| 4,535,611 | 8/1985 | Masuda | 68/202 |
| 4,548,611 | 10/1985 | Paterson et al. | 68/202 |
| 5,000,017 | 3/1991 | Petersen | 69/32 |
| 5,235,829 | 8/1993 | Belluzzi | 69/32 |
| 5,255,539 | 10/1993 | Zimmer | 68/202 |

FOREIGN PATENT DOCUMENTS

| | | | |
|---|---|---|---|
| 737463 | 6/1980 | U.S.S.R. | 69/32 |
| 8907155 | 8/1989 | WIPO | 69/32 |
| 9210603 | 6/1992 | WIPO | 68/204 |

*Primary Examiner*—Michael A. Neas
*Attorney, Agent, or Firm*—Lalos & Keegan

[57] ABSTRACT

A moving piece of leather on a bearing support will be moved parallel to a moving open-porous-structured, mesh-like (strainer) belt, the pores or meshes being filled with fluid. This fluid will be transmitted by pressure onto the leather surface.

The pressure can be caused either by a pressure roll, or an oscillating zone of pressure, rotating bristle or a linear air or steam flow. The applied amount will be controlled by the relative speed between the leather surface and the mesh-like (strainer) belt.

13 Claims, 3 Drawing Sheets

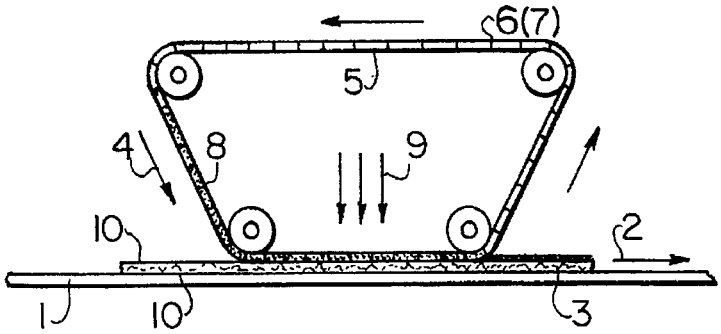
FIG. 1
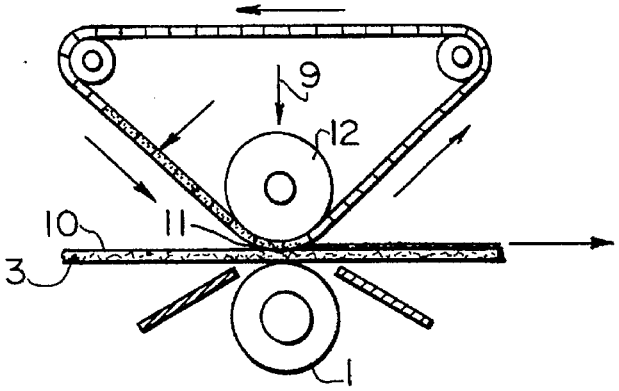
FIG. 2(a)
FIG. 2(b)
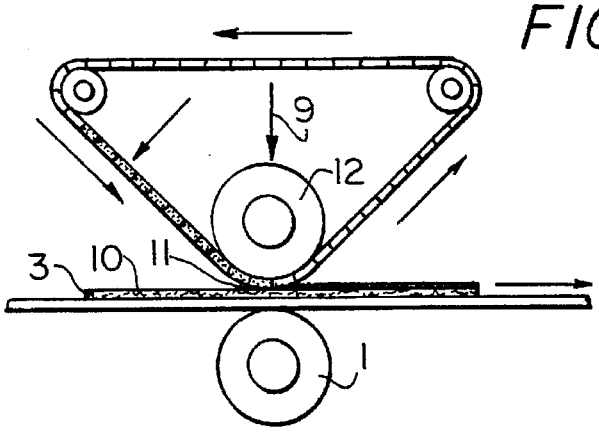

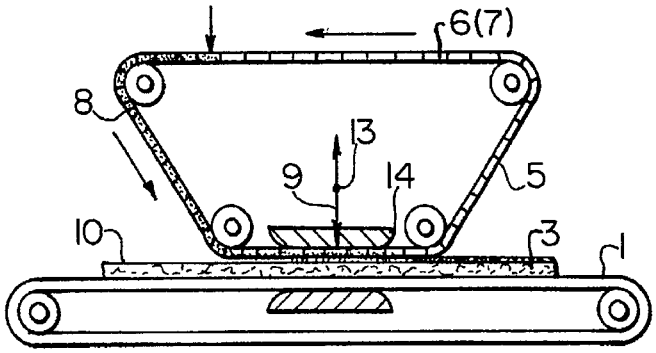
FIG. 3
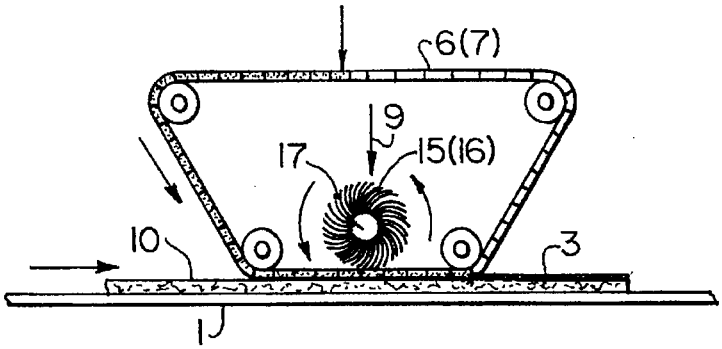
FIG. 4
FIG. 5
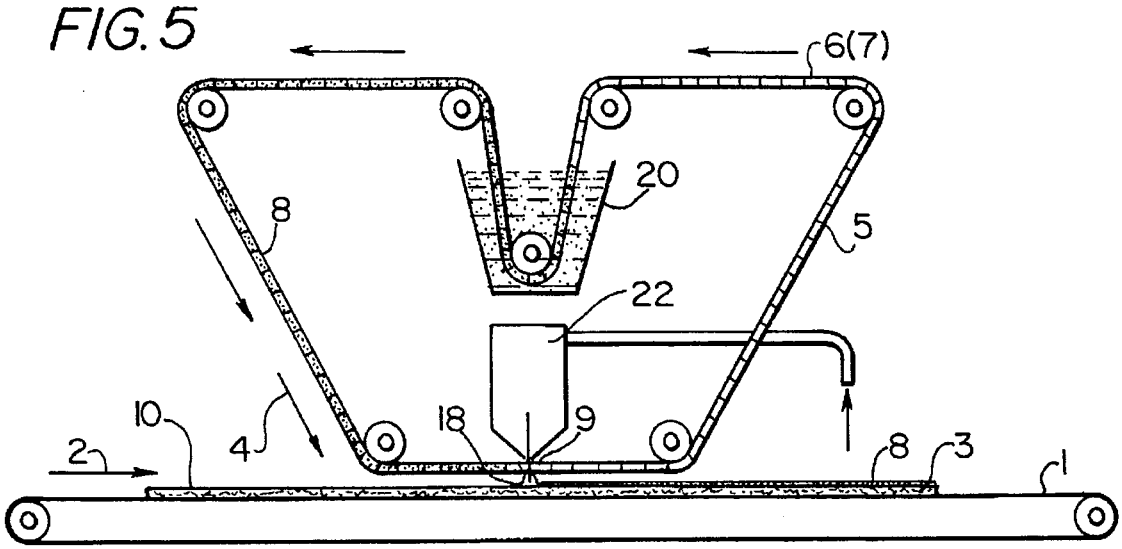

PROCESS AND DEVICE FOR APPLYING LIQUIDS TO THE SURFACE OF LEATHER OR SIMILAR FLAT MATERIALS

BACKGROUND OF THE INVENTION

The application of fluids to a leather surface is one of the most important operations for the finishing of leather in leather production.

The most common procedures are the spraying of fluid using an air pressure pistol (compressed air jet), the pouring of a thin layer and more recently the so-called pressure procedure using a perforated roll.

All three procedures have advantages and disadvantages.

The spraying procedure using air pressure delivered from rotating nozzles yields the finest layers but it causes a high amount of pollution and results in the highest amount of fluid losses (for example color).

The pouring procedure, which utilizes fluid layers, will cause less pollution, but it can only be applied with special fluids and requires larger application amounts. The pieces of leather must run through at a relatively high speed, which will cause great difficulties when dealing with the synchronization of the drying facility.

The pressure procedure, which uses perforated rolls, will minimize the consumption of fluids (color) and is practicable for a variety of different kinds of fluid and application amounts. Disadvantages of this procedure include the fact that different, relatively expensive application rolls have to be used for the various application amounts. Further, the exchange of rolls is time consuming. The integration of machines with pressure rolls into the drying lane will also cause problems. The running through of leather that is not perfectly smooth will be a problem due to the fact that the leather will crease easily and thus is not possible without a spreading device.

SUMMARY OF THE INVENTION

The device and procedure of the present invention eliminates almost all disadvantages of the above mentioned procedures. The new procedure will work as follows. A piece of leather lying on a bearing support will be moved in parallel with a moving belt having an open-porous structure similar to meshes, whereby the pores or meshes are filled with fluid and the fluid will be transmitted onto the leather surface by pressure. The induction of fluid into exactly defined pores or meshes of the belt into the zone of pressure yields an exactly defined amount of fluid. The application amount of the fluid will be defined or controlled by the relative speed of the leather surface and the meshed or porous-structured belt.

BRIEF DESCRIPTION OF THE DRAWINGS

The transmittal of fluid from the meshes or pores of the belt onto the leather surface by pressure can be realized in various ways, which can be seen in the figures wherein:

FIG. 1 is a general, diagrammatic view of the apparatus of the present invention.

FIGS. 2(*a*) and 2(*b*) are diagrammatic views of a pressure roller embodiment of the present invention.

FIG. 3 is a diagrammatic view of an oscillating pressure tool embodiment of the present invention.

FIG. 4 is a diagrammatic view of a roller with bristles or lamellas embodiment of the present invention.

FIG. 5 is a diagrammatic view of a linear air flow embodiment of the present invention.

In the Figures, the numbers will refer to:

Figure 6A:
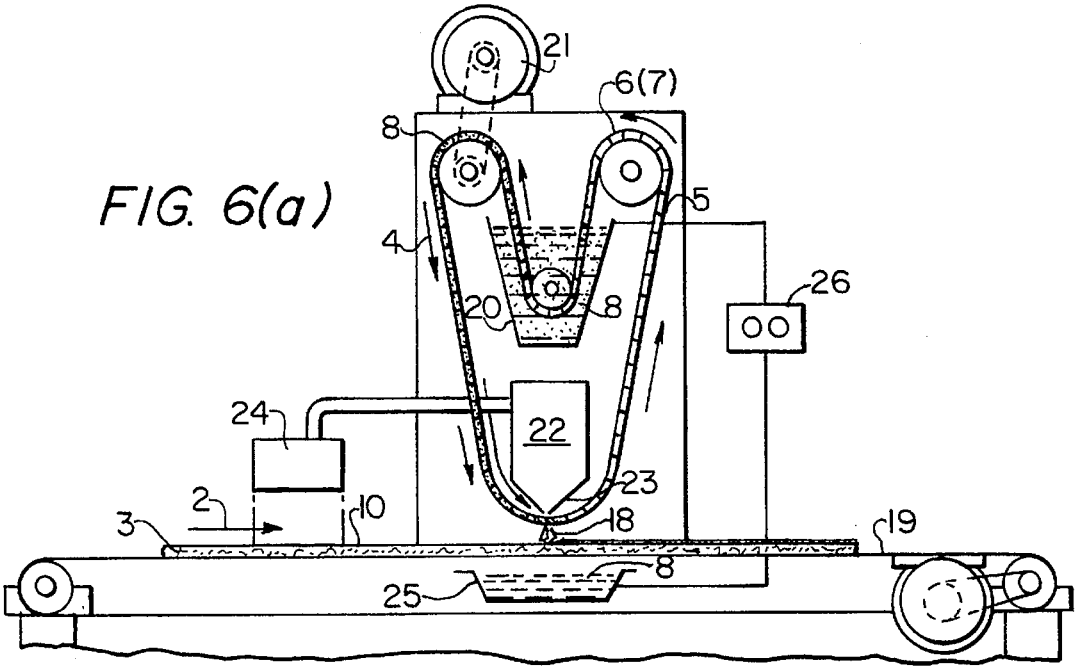
FIG. 6(*a*) provides a more complete diagrammatic view of a system with linear air flow and 6(*b*) shows the resultant treatment from the system of 6(*a*).

Bearing support 1
direction of movement of leather 2
leather 3
direction of movement of belt 4
mesh-like belt 5
pores 6
meshes 7
fluid 8
pressure effect 9
leather surface 10
linear zone of pressure 11
roll 12
oscillation (pulsations) 13
tools 14
bristles 15
lamellas 16
bristle (lamella) roll 17
air flow 18
thread of the conveyor belt 19
upper fluid container 20
belt drive 21
air pressure compartment 22
linear nozzle 23
pressurizing facility 24
lower fluid container 25
fluid pump 26

DETAILED DESCRIPTION

The procedure of the present invention is principally described with reference to FIG. 1. The leather 3 is moved on a movable bearing support 1 in direction 2. The mesh-like 6 or open-porous-structured 7 belt will be lead parallel to the leather surface 10 along course 4. The belt 5 will contain fluid 8 in the meshes 6 or in the pores 7. In the zone of pressure 9 the fluid 8 will be transmitted onto the leather surface 10.

The pressure movement 9 in the zone of pressure can be effected either by a pressure roll 12 (FIG. 2*a* and 2*b*) or by an oscillation 13 of a tool 14 (FIG. 3) or by a rotating bristle 15 or by a lamella roll 16 (FIG. 4). A very effective alternative to this procedure is the pressure output by a linear air flow 18 (FIG. 5).

Based on this procedure, various facilities can be built that will have various constructive advantages.

Figure 6B:
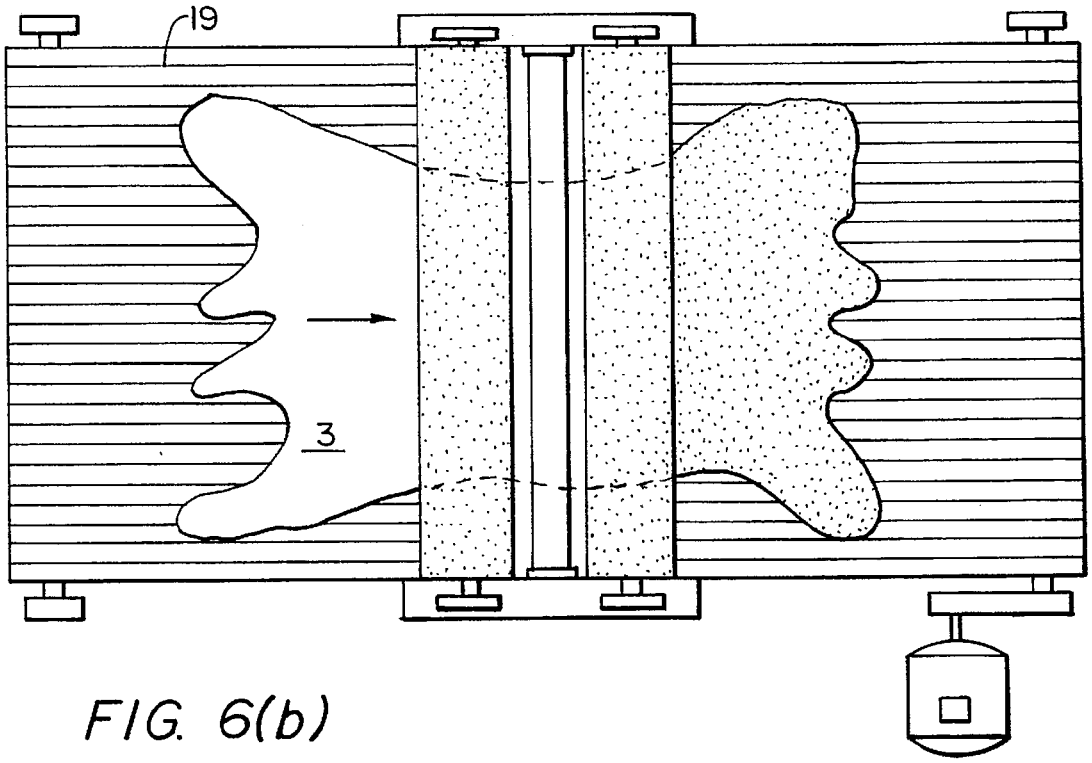

FIG. 6 shows in detail an exemplary device, that works with a linear air flow or steam flow within the zone of pressure. The piece of leather 3 is moved on a conveyor belt (direction 2) which consists of a number of relatively thin threads 19. The threads 19 have advantageously a surface for fluids (colors) which is anti-adhesive.

The mesh-like or porous structured belt 5, which runs above the leather surface 10, is filled with fluid 8 in the upper fluid container 20. The belt 5 will be directed by its movement alongside the nozzle beam 22 with linear nozzles 23. The air pressure flow 18 transmits the fluid 8 out of the meshes 6 or the pores 7 of the belt 5 directly onto the surface 10 of the leather 3. The belt 5 is moved by a controllable drive. The nozzle beam 22 is connected to the air pressure production unit 24. Fluid 8 that is not transmitted to the surface 10 of the leather 3, will run into the lower fluid container 25, which is installed below the upper strands of the conveyor belt threads 19. The fluid 8 out of container 25 will be transmitted by a pump 26 into the upper container.

Other devices can be realized as well, as per FIGS. 2*a–b* and 3–4. The advantages of the procedure and the devices according to this invention can be characterized as follows.

Due to the exact and defined geometry of the meshes 6 or pores 7 of the belt 5 the amount of fluid which is transmitted onto the leather surface can be defined.

The procedure works with a minimum loss of fluid and causes almost no pollution during application. The processing of irregular pieces of leather will not cause any problems. The amount of fluid applied (amount of color) per surface unit, will be regulated by the speed of the belt (5). The procedure and device will cause few problems and is very practicable.

We claim:

1. A process for applying a fluid to a surface of a leather material comprising:

conveying said material on a bearing support;

filling pores of a porous belt with said fluid;

moving said belt in parallel with said conveyed material at a spaced distance above said material;

applying pressure to said belt to cause said fluid to be discharged from said pores and onto said material in an amount commensurate with the geometry of the pores of the belt and the relative velocity between the belt and the material.

2. A process as in claim 1 including applying a pulsating pressure to said belt.

3. A process as in claim 1 wherein said step of applying pressure includes rolling a roller against said belt.

4. A process as in claim 1 wherein said step of applying pressure includes directing a linear air flow toward said belt.

5. A process as in any one of claims 1 through 4 including varying the amount of fluid applied to the material by varying the relative velocity between the belt and the material.

6. A device for applying a fluid to a surface of a leather material comprising:

a bearing support for conveying said material;

an endless porous belt including a plurality of pores having a defined geometry;

a means for filling said pores with said fluid;

a means for moving said belt in parallel to said conveyed material at a distance above said material;

a means for applying pressure to said belt to cause said fluid to be discharged from said pores of said belt onto said material in an amount commensurate with the geometry of said pores and the relative velocity between the belt and the material.

7. A device as in claim 6 wherein said means for applying pressure includes an oscillating tool.

8. A device as in claim 6 wherein said means for applying pressure includes a roll with bristles.

9. A device as in claim 6 wherein said means for applying pressure includes a means for delivering an air stream toward said belt.

10. A device as in claim 6 wherein said means for delivering an air stream includes at least one linear nozzle.

11. A device as in claim 6 wherein said means for delivering an air stream includes a plurality of linear nozzles.

12. A device as in any one of claims 1 through 11 wherein said bearing support includes a plurality of threads having an anti-adhesive surface.

13. A device as in any one of claims 6 through 11 including a means for controlling the speed of said belt to vary the relative speed between said belt and said material to vary the amount of fluid applied to said material.

* * * * *